US012089670B1

(12) United States Patent
Louissaint

(10) Patent No.: US 12,089,670 B1
(45) Date of Patent: Sep. 17, 2024

(54) DISPOSABLE, SOAP-DISPENSING BATHING GLOVE

(71) Applicant: Arthur Louissaint, New York, NY (US)

(72) Inventor: Arthur Louissaint, New York, NY (US)

( * ) Notice: Subject to any disclaimer, the term of this patent is extended or adjusted under 35 U.S.C. 154(b) by 163 days.

(21) Appl. No.: 17/578,607

(22) Filed: Jan. 19, 2022

(51) Int. Cl.
*A47K 7/02* (2006.01)
*A41D 19/00* (2006.01)

(52) U.S. Cl.
CPC ..... *A41D 19/0006* (2013.01)

(58) Field of Classification Search
CPC ... A41D 19/0006; A41D 19/0079; A47K 7/02
See application file for complete search history.

(56) References Cited

U.S. PATENT DOCUMENTS 1,209,763 A * 12/1916 Rosengren ..... A47L 13/19 601/138
4,825,499 A 5/1989 Baptiste
5,169,251 A 12/1992 Davis
5,673,435 A 10/1997 Gebhard
6,098,234 A * 8/2000 Jackson, Jr. ..... A47K 7/02 15/118
6,398,443 B1 * 6/2002 Barela ..... A47K 7/03 401/7
6,968,808 B2 11/2005 Claire
D544,665 S 6/2007 Keene
2004/0103467 A1 * 6/2004 Schmitt ..... A41D 19/0075 2/159
2005/0220847 A1 * 10/2005 Benjamin ..... A47K 7/03 424/443
2007/0192975 A1 8/2007 Aseff
2010/0287720 A1 11/2010 Kayata, Sr.
2011/0088190 A1 * 4/2011 Clark ..... A47K 7/02 15/227
2019/0313861 A1 * 10/2019 Moore ..... A47K 7/03
2020/0060482 A1 * 2/2020 Lee ..... A47K 7/02

FOREIGN PATENT DOCUMENTS

WO 2004080256 9/2004

* cited by examiner

*Primary Examiner* — Tajash D Patel
(74) *Attorney, Agent, or Firm* — Kyle A. Fletcher, Esq.

(57) ABSTRACT

The disposable soap-dispensing bathing glove is a garment. The disposable soap-dispensing bathing glove is adapted for use with a patient. The disposable soap-dispensing bathing glove is a glove. The disposable soap-dispensing bathing glove is worn on the hand of the patient. The disposable soap-dispensing bathing glove applies a soap to a surface that comes in contact with the patient. The disposable soap-dispensing bathing glove comprises a glove structure and a plurality of soap balls. The plurality of soap balls attach to the glove structure. The glove structure is rubbed against the surface that comes in contact with the patient to: a) dispense the soap from the plurality of soap balls; and, b) generate a friction used to clean the surface that comes in contact with the patient.

13 Claims, 2 Drawing Sheets

DISPOSABLE, SOAP-DISPENSING BATHING GLOVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of bathing gloves containing soap.

BACKGROUND

The human hand is a grasping structure. The human hand of the left side of the body is a mirror image of the human hand of the right side of the body. The orientation is used to define the palm side of the hand. Specifically, the left hand and the right hand can only be overlaid on top of each other when the palm side of the left hand is touching the palm side of the right hand. The side of the hand opposite to the palm side is referred to as the back side. The human hand is further defined with a thumb (first finger), index finger (second finger), middle finger (third finger), ring finger (fourth finger), and a little finger (fifth finger).

A glove is an item of apparel that covers a hand. The glove comprises five finger stalls into which the fingers of the hand are inserted. Each finger stall is attached to a trank. The trank is the portion of the glove that covers the palm of the hand. The palm side of the trank is proximal to the palm side of the hand. The back side of the trank is proximal to the back side of the hand. Typically: 1) the thumb is inserted into the first finger stall; 2) the index finger is inserted into the second finger stall; 3) the middle finger is inserted into the third finger stall; 4) the ring finger is inserted into the fourth finger stall; and, 5) the little finger is inserted into the fifth finger stall.

SUMMARY OF INVENTION

The disposable soap-dispensing bathing glove is a garment. The disposable soap-dispensing bathing glove is adapted for use with a patient. The disposable soap-dispensing bathing glove is a glove. The disposable soap-dispensing bathing glove is worn on the hand of the patient. The disposable soap-dispensing bathing glove applies a soap to a surface that comes in contact with the patient. The disposable soap-dispensing bathing glove comprises a glove structure and a plurality of soap balls. The plurality of soap balls attach to the glove structure. The glove structure is rubbed against the surface that comes in contact with the patient to: a) dispense the soap from the plurality of soap balls; and, b) generate a friction used to clean the surface that comes in contact with the patient.

These together with additional objects, features and advantages of the disposable soap-dispensing bathing glove will be readily apparent to those of ordinary skill in the art upon reading the following detailed description of the presently preferred, but nonetheless illustrative, embodiments when taken in conjunction with the accompanying drawings.

In this respect, before explaining the current embodiments of the disposable soap-dispensing bathing glove in detail, it is to be understood that the disposable soap-dispensing bathing glove is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the disposable soap-dispensing bathing glove.

It is therefore important that the claims be regarded as including such equivalent construction insofar as they do not depart from the spirit and scope of the disposable soap-dispensing bathing glove. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
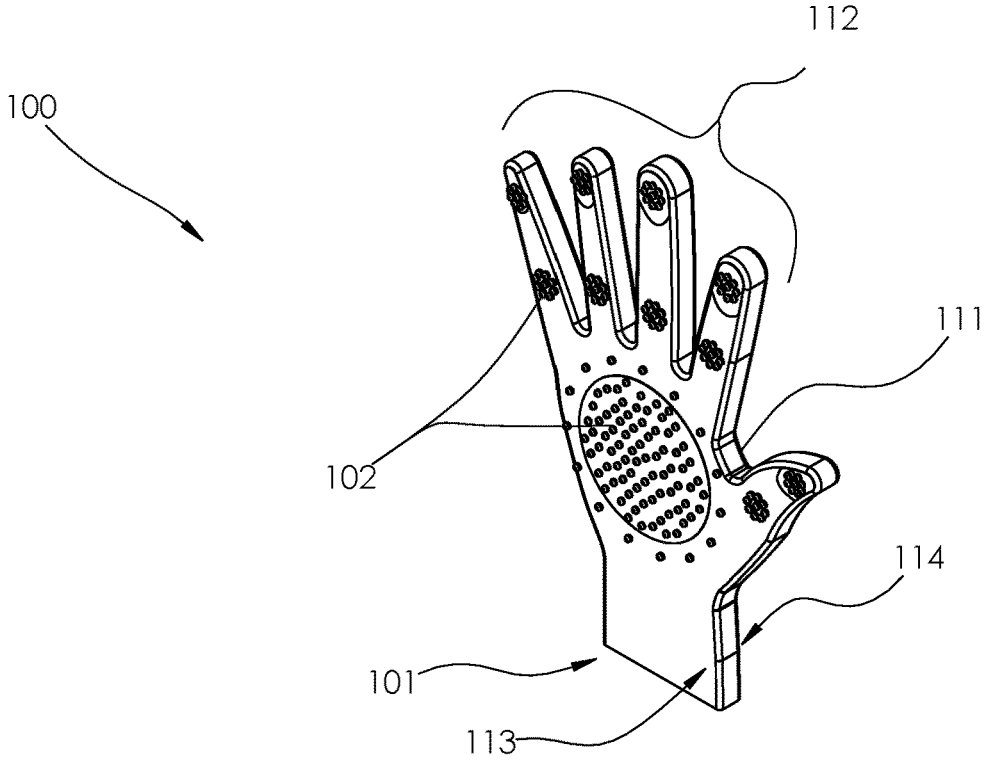
FIG. 1 is a perspective view of an embodiment of the disclosure.
Figure 2:
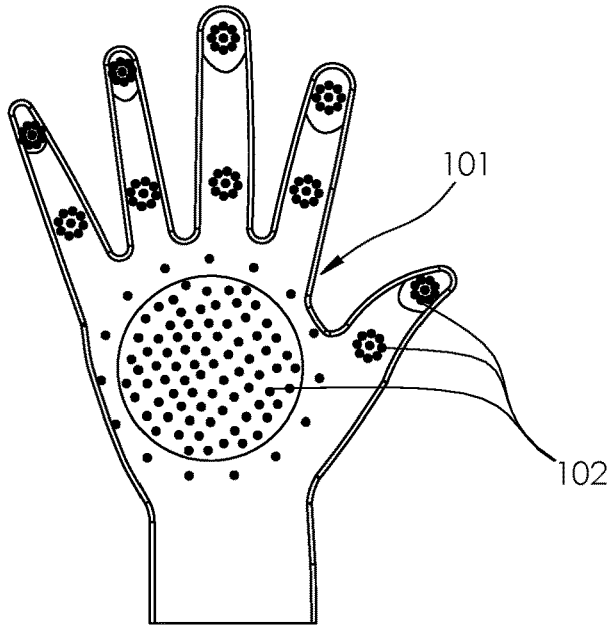
FIG. 2 is a front view of an embodiment of the disclosure.
Figure 3:
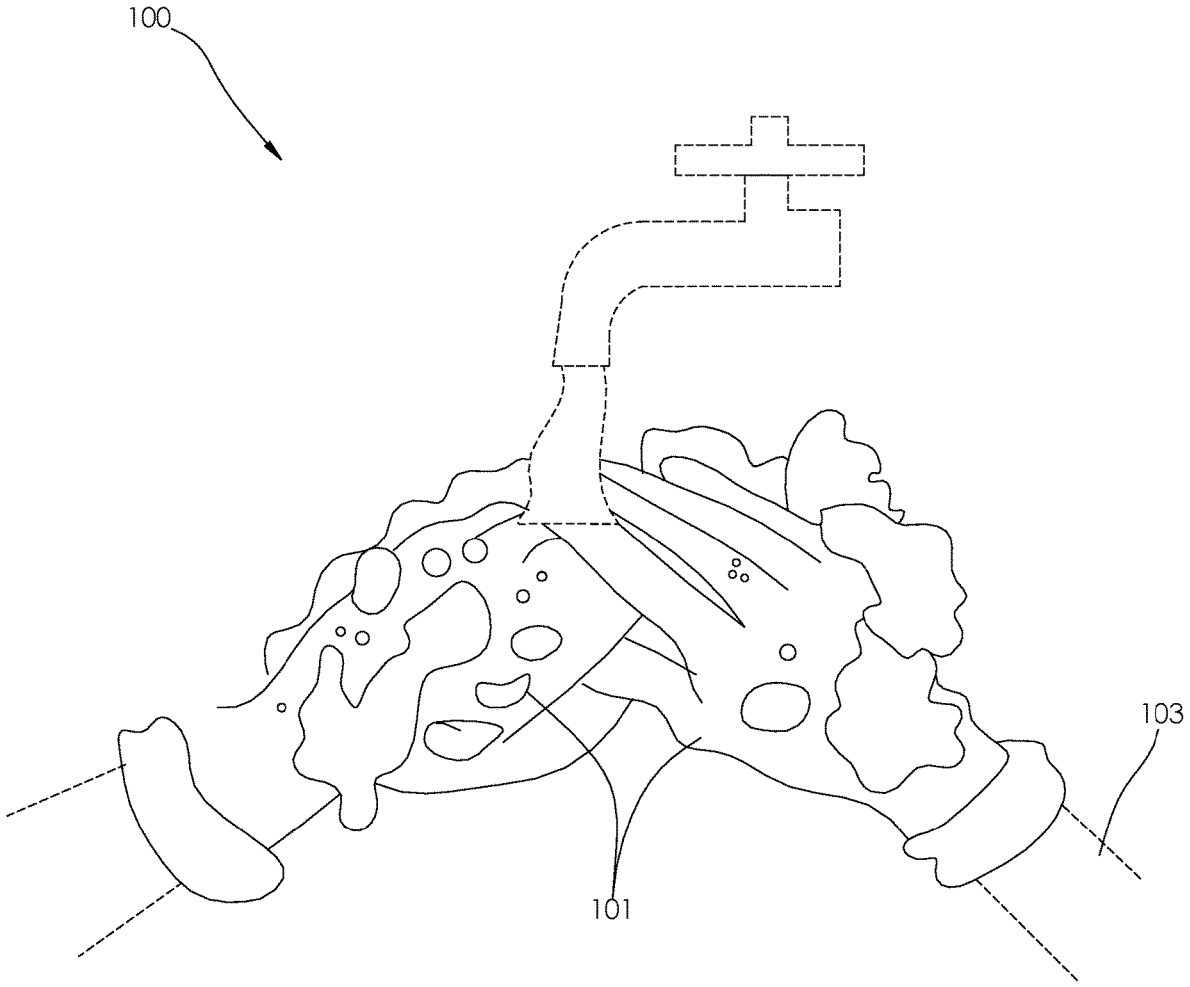
FIG. 3 is a side view of an embodiment of the disclosure.

Detailed reference will now be made to one or more potential embodiments of the disclosure, which are illustrated in FIGS. 1 through 3.

The disposable soap-dispensing bathing glove 100 (hereinafter invention) is a garment. The invention 100 is adapted for use with a patient 103. The invention 100 is a glove. The invention 100 is worn on the hand of the patient 103. The invention 100 applies a soap to a surface that comes in contact with the patient 103. The invention 100 comprises a glove structure 101 and a plurality of soap balls 102. The plurality of soap balls 102 attach to the glove structure 101. The glove structure 101 is rubbed against the surface that comes in contact with the patient 103 to: a) dispense the soap from the plurality of soap balls 102; and, b) generate a friction used to clean the surface that comes in contact with the patient 103. The patient 103 is an individual designated to receive the services of the invention 100.

The glove structure 101 is a garment. The glove structure 101 is worn on the hand of a patient 103. The glove structure 101 forms a tool used to clean a surface that comes in contact with the patient 103. The glove structure 101 generates a friction when rubbed against the surface that comes in contact with the patient 103. The glove structure 101 comprises a trank 111, a plurality of finger stalls 112, a palm side 113, and a back side 114.

The trank 111 forms the surfaces of the glove structure 101 that encloses the region of the hand of the patient 103 located between the wrist and the plurality of the fingers of the patient 103.

Each finger stall selected from the plurality of finger stalls 112 is a sleeve. Each finger stall selected from the plurality of finger stalls 112 attaches to the trank 111. Each finger stall selected from the plurality of finger stalls 112 is sized to receive a finger of the patient 103 when the patient 103 wears the glove structure 101.

The palm side 113 of the glove structure 101 is the surface of the glove structure 101 that is proximal to the palm of the hand of the patient 103. The back side 114 of the glove structure 101 is the surface of the glove structure 101 that is distal from the palm of the hand of the patient 103.

Each soap ball selected from the plurality of soap balls 102 is a solid phase chemical compound. The solid phase chemical compound is a surfactant that dissolves both in non-polar and polar solvents such as a liquid phase lipid and liquid phase water respectively. Each soap ball selected from the plurality of soap balls 102 is a cleaning agent used to clean the surface that comes in contact with the patient 103. The plurality of soap balls 102 are rubbed against the surface that comes in contact with the patient 103.

Each soap ball selected from the plurality of soap balls 102 mounts on the glove structure 101. Each soap ball selected from the plurality of soap balls 102 releases the solid phase chemical compound when the selected soap ball is rubbed against the surface that comes in contact with the patient 103. Each soap ball selected from the plurality of soap balls 102 releases the solid phase chemical compound when the selected soap ball is exposed to a solvent selected from the group consisting of: a) a liquid phase non-polar solvent; and, b) a liquid phase polar solvent.

Each soap ball selected from the plurality of soap balls 102 is identical. Each soap ball selected from the plurality of soap balls 102 is formed as the major section of a spherical section. Each soap ball selected from the plurality of soap balls 102 permanently attaches to the exterior surface of the glove structure 101. Each soap ball selected from the plurality of soap balls 102 attaches to the glove structure 101 such that the bifurcating plane of the spherical section structure of the selected soap ball sits flush on the palm side 113 of the glove structure 101.

The plurality of soap balls 102 are distributed across: a) the palm side 113 of the trank 111 of the glove structure 101; and, b) the palm side 113 of each finger stall selected from the plurality of finger stalls 112 of the glove structure 101.

The glove structure 101 and the plurality of soap balls 102 combine to form a disposable structure. The combination of the glove structure 101 and the plurality of soap balls 102 are disposed of after the chemical compound that forms the plurality of soap balls 102 has been consumed.

The following definitions were used in this disclosure:

Appendage: As used in this disclosure, appendage is a generic term used to describe one or more limbs of a patient.

Carboxylic Acid: As used in this disclosure, a carboxylic acid is an organic molecule that further comprises the carboxyl functional group.

Carboxyl Functional Group: As used in this disclosure, the carboxyl functional group is a functional group with the chemical formula —COOH.

Chemical: As used in this disclosure, a chemical refers to a substance of a known or fixed composition. The term chemical is used to describe the substance when the details of the composition of the substance or properties of the substance are considered relevant to the disclosure at bar. The term properties is taken to mean both the measurable properties of the substance and the interactions of a first chemical with a second chemical. The term compound refers to: a) a chemical structure that comprises a one or more chemical bonds; or, b) a unified chemical structure formed from mixture of chemicals. The term compound is informally considered a synonym for the term chemical. The term chemistry refers to the study and the use of the knowledge of the composition and properties of chemicals. The terms chemical reaction refers to the interactions between two or more chemical structures.

Chemical Bond: As used in this disclosure, a chemical bond refers to an attractive force between a first molecule or atom and a second molecule or atom. The primary bonds include, but are not limited to, covalent bonds, ionic bonds, and hydrogen bonds.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Cleaning Agent: As used in this disclosure, a cleaning agent is a chemical compound used to remove pathogens, dirt, and detritus from a surface.

Cleaning Solution: As used in this disclosure, a cleaning solution is a chemical solution that contains a solvent used to dissolve a cleaning agent.

Covalent Bond: As used in this disclosure, a covalent bond refers to a chemical bond between a first atom and a second atom wherein the first atom and the second atom share each share one or more electrons with each other. This is in contrast to an ionic bond.

Dilute Solution: As used in this disclosure, a dilute solution refers to the concentration of a solute within a solvent. Specifically, a solute is considered to have a dilute concentration if a person skilled in the art would not consider the presence of the solute at the dilute concentration to have practical significance within the context of the disclosure.

Disposable: As used in this disclosure, an object is disposable if the object is not reusable.

Dissolve: As used in this disclosure, to dissolve refers to the incorporation of a solute into a solvent to form a solution.

Extremity: As used in this disclosure, extremity is a generic term used to describe either the hand and/or foot of a person. The extremity is located and the distal end of an appendage.

Fatty Acid: As used in this disclosure, a fatty acid refers to a carboxylic acid with a continuous carbon chain of greater than 3 carbon atoms beyond the carboxyl functional group.

Finger: As used in this disclosure, a finger is the portion of the hand that encloses the proximal phalange bone and its associated distal phalange bone of a hand. The finger nail is a claw like structure that is formed at the distal end of the finger. The finger of the hand that is formed without an intermediate phalange bone is referred to as the thumb. When sequentially numbering the fingers of the hand, the thumb is taken to be the first finger.

Finger Stall: As used in this disclosure, a finger stall refers to: 1) the roughly cylindrical structure associated with a glove into which a finger may be inserted; or, 2) a roughly cylindrical cover, commonly referred to as a finger cot, that is placed directly over a finger to cover the finger.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Impermeable: As used in this disclosure, the term fluid impermeable refers to: a) the ability of a structure to not allow a fluid to pass through the structure; or, b) the ability of a material not absorb through the exterior surfaces of the material a fluid that the material is immersed in or exposed to.

Flush: As used in this disclosure, the term flush is used to describe the alignment of a first surface and a second surface to form a single structure selected from the group consisting of a Euclidean plane and a non-Euclidean plane.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Functional Group: As used in this disclosure, a functional group is specific chemical structure that 1) defines the structure of a chemical family; and, 2) determines the properties of the chemical family. Common functional groups include, but are not limited to, aldehydes, alkanes, alkenes, alkynes, alcohols, amides, amines, carboxylic acids, esters, ethers, haloalkanes, haloalkenes, haloalkynes, and ketones. As a practical matter, the intention of this definition is to use the term functional group in the same manner as the term is commonly used in organic chemistry.

Garment: As used in this disclosure, a garment is a textile based structure that is used to cover an individual. Clothes, clothing, and apparel are synonyms for garment.

Gas: As used in this disclosure, a gas refers to a state (phase) of matter that is fluid and that fills the volume of the structure that contains it. Stated differently, the volume of a gas always equals the volume of its container.

Glove: As used in this disclosure, a glove is an item of apparel that covers a hand. The glove comprises five finger stalls into which the fingers of the hand are inserted. The glove further comprises the trank which encloses the hand form the fingers to the wrist. A glove is further defined with a palm side and a back side. The palm side is proximal to the palm of the hand. The back side is distal from the palm side.

Hand: As used in this disclosure, the hand is the extremity of the arm. The hand attaches to the wrist at the end that is distal from the shoulder. The hand comprises a plurality of metacarpal bones and a plurality of phalange bones.

Hemisphere: As used in this disclosure, a hemisphere is a structure formed in the shape of a half a sphere. Such a structure would be described as hemispherical. The terms hemisphere and semisphere are interchangeable.

Hydrogen Bond: As used in this disclosure, a hydrogen bond refers to an electrostatic attraction between: 1) a cation and an anion; 2) a cation and a negative dipole; or, 3) an anion and a positive dipole. The exchange of electrons (as would occur in an ionic bond or covalent bond) does not occur in a hydrogen bond. As a rule, the energy to break an ionic bond is less that the energy required to break a covalent bond or an ionic bond.

Interphalangeal Joint: As used in this disclosure, the interphalangeal joint refers to: 1) the joint that attaches a first selected phalange to a second selected phalange; or, 2) the joint that attaches a phalange to a metacarpal.

Ionic Bond: As used within this disclosure, an ionic bond refers to a chemical bond between a first atom and a second atom wherein the first atom takes an electron from the second atom. This is in contrast to a covalent bond.

Liquid: As used in this disclosure, a liquid refers to a state (phase) of matter that is fluid and that maintains, for a given pressure, a fixed volume that is independent of the volume of the container.

Metacarpal Bone: As used in this disclosure, the metacarpal bone refers to one of several bones of the hand that are enclosed by the palm of the hand. The metacarpal bones attach the bones of the wrist to the phalange bones of the fingers.

Mirror Image: As used in this disclosure, a mirror image refers to a second object that is a reproduction of a first object wherein the second object is identical to the first object except that the orientation of the second object is reversed relative to the first object as if the second object has been reflected by a plane of a mirror (often called the mirror plane or plane of reflection).

Mitten: As used in this disclosure, a mitten is an item of apparel that covers a hand. The mitten comprises a single finger stall into which a thumb may be inserted. A mitten is further defined with a palm side and a back side. The palm side is proximal to the palm of the hand. The back side is distal from the palm side. See Finger Stall Non-Polar Molecule: As used in this disclosure, a non-polar molecule refers to a molecular structure that: a) is electrically neutral; and, b) has a uniform spatial distribution of the electrons within the molecule.

Palm: As used in this disclosure, the palm of the hand is identified as the portions of a left hand and a right hand between the fingers and the wrist that contact each other when the left hand presses against the right hand when the left hand and right hand are in alignment. The palm encloses the metacarpal bones of the hand. The palm of the left hand is the mirror image of the palm of the right hand. The palm encloses the metacarpal bones of the hand.

Phalange Bone: As used in this disclosure, the phalange bone refers to one of several bones of the hand that are enclosed by the fingers of the hand.

Phase: As used in this disclosure, phase refers to the state of the form of matter. The common states of matter are solid, liquid, gas, and plasma.

Plasma: As used in this disclosure, plasma refers to a state (phase) of matter wherein the outer valence electrons of an atom (or molecule) have been separated from their nucleus but remain with the matter. A plasma is an electrically neutral state of matter that is formed from the ions of the separated atoms. Plasmas generally, but not necessarily behaves like a gas in that a plasma fills the volume of the structure that contains it. The flow of a plasma through the atmosphere is called an arc. An arc is generally created when the atmosphere is subjected to an electric field that ionizes the molecules forming the atmosphere.

Polar Molecule: As used in this disclosure, a polar molecule refers to a molecular structure that: a) is electrically neutral; but, b) does not have a uniform spatial distribution of the electrons within the molecule. A polar molecule will present one or more electrically positive poles and the same number of electrically negative poles within the molecular structure.

Polarity: As used in this disclosure, the term polarity is used to describe a physical property or physical characteristic wherein: 1) the physical property or physical characteristic manifests two opposing attributes, tendencies, characteristics, or principals; and, 2) the two opposing attributes, tendencies, characteristics, or principals have an intrinsic separation, alignment, or orientation.

Purlicue: As used in this disclosure, the purlicue refers to the space between the thumb and the index finger of a hand.

Rub: As used in this disclosure, to rub is a verb that means to slide a first object against a second object such that friction is generated between the two objects.

Salt: As used in this disclosure, a salt means an ionic compound that further comprises at least one atom of a metallic element or compound and one atom of a non-metallic element or compound. When dissolved in water, the ionic compound releases the metallic element and the non-metallic element into the water as ions. In this disclosure, a metallic element is assumed to include the alkali metals and the alkali earth metals. Alternatively, and equivalently, a metallic element may be assumed to be any element on the periodic table that is to the left of the metalloids.

Semisphere: As used in this disclosure, a semisphere is a structure formed in the shape of a half a sphere. Such a structure would be described as semispherical.

Solid: As used in this disclosure, a solid refers to a state (phase) of matter that: 1) has a fixed volume; and, 2) does not flow.

Solution: As used in this disclosure, a solution is a uniform mixture of two or more compounds in a liquid phase. The major component selected from the two or more compounds that forms the solution is called the solvent. The components remaining in the two or more compounds are called the solute. A polar solvent is a solvent formed from polar molecules. A non-polar solvent is a solvent formed from non-polar molecules. The rule of thumb that "like dissolves like" states that: a) solutes formed from polar molecules will dissolve in polar solvents but will not dissolve in non-polar solvents; and, b) solutes formed from non-polar molecules will dissolve in non-polar solvents but will not dissolve in polar solvents.

Sphere: As used in this disclosure, a sphere refers to a structure wherein every point of the surface of the structure is equidistant from a center point.

Spherical Section: As used in this disclosure, a spherical section refers one of the two objects formed by the bifurcation of a sphere by a plane that does not pass through the center of the sphere. The major section is the spherical section that contains the larger volume. The minor section is the spherical section that contains the smaller volume. A spherical section is commonly called a spherical cap. The term spherical section is also applied to a semi-spherical structure.

Soap: As used in this disclosure, a soap is a cleansing chemical that is used in cleaning an object. A soap is generally formed from a mixture of one or more salts and one or more fatty acids.

Surfactant: As used in this disclosure, a surfactant is a substance that decreases the surface tension of a fluid. Within water, a surfactant often comprises polar and non-polar functional groups for the purpose of improving the solubility of otherwise non-soluble substances in water.

Therapeutic: As used in this disclosure, therapeutic is an adjective that refers to a medical, ameliorative, or hygienic substance, process, procedure, or device.

Tool: As used in this disclosure, a tool is a device, an apparatus, or an instrument that is used to carry out an activity, operation, or procedure. A tool generally comprises a working element and a handle.

Trank: As used in this disclosure, the trank refers to the portion of a glove that covers the hand from the fingers to the wrist.

Water: As used in this disclosure, water (CAS 7732-18-5) is a molecule comprising two hydrogen atoms and one oxygen molecule. The phase of water at normal temperature and pressure is liquid. As used in this disclosure, the definition of water is expanded to include dilute water-based solutions of salts and ionic structures using water as the solvent. Water in a gas phase is often referred to as steam. Water in a solid phase is often referred to as ice. Snow refers to a bulk solid form of ice.

Working Element: As used in this disclosure, the working element of a tool is the physical element on the tool that performs the actual activity, operation, or procedure the tool is designed to perform. For example, the cutting edge of a blade is the working element of a knife.

Wrist: As used in this disclosure, the wrist refers to an eight bone structure within the human body that flexibly attaches the radial bone and the ulna bone to the metacarpal bones of the hand.

With respect to the above description, it is to be realized that the optimum dimensional relationship for the various components of the invention described above and in FIGS. 1 through 3 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A disposable soap-dispensing bathing glove comprising a glove structure and a plurality of soap balls;

wherein the plurality of soap balls attach to the glove structure;

wherein the disposable soap-dispensing bathing glove applies a soap to a surface that comes in contact with the patient;

wherein the glove structure comprises a trank, a plurality of finger stalls, a palm side, and a back side;

wherein the trank forms the surfaces of the glove structure that is adapted to enclose a region of the hand of the patient located between a wrist and a plurality of fingers of the patient;

wherein each finger stall selected from the plurality of finger stalls is a sleeve;

wherein each finger stall selected from the plurality of finger stalls attaches to the trank;

wherein each finger stall selected from the plurality of finger stalls is adapted to be sized to receive a finger of the patient when the patient wears the glove structure;

wherein the palm side of the glove structure is the surface of the glove structure that is adapted to be proximal to the palm of the hand of the patient;

wherein the back side of the glove structure is the surface of the glove structure that is adapted to be distal from the palm of the hand of the patient.

2. The disposable soap-dispensing bathing glove according to claim 1 wherein the disposable soap-dispensing bathing glove is a garment;

wherein the disposable soap-dispensing bathing glove is adapted for use with a patient;

wherein the disposable soap-dispensing bathing glove is a glove;

wherein the disposable soap-dispensing bathing glove is worn on the hand of the patient.

3. The disposable soap-dispensing bathing glove according to claim 2 wherein the glove structure is rubbed against the surface that comes in contact with the patient to: a) dispense the soap from the plurality of soap balls; and, b) generate a friction used to clean the surface that comes in contact with the patient.

4. The disposable soap-dispensing bathing glove according to claim 3 wherein the glove structure is a garment;

wherein the glove structure is worn by the patient.

5. The disposable soap-dispensing bathing glove according to claim 4 wherein the glove structure forms a tool used to clean a surface that comes in contact with the patient;

wherein the glove structure generates a friction when rubbed against the surface that comes in contact with the patient.

6. The disposable soap-dispensing bathing glove according to claim 5 wherein each soap ball selected from the plurality of soap balls is a cleaning agent used to clean the surface that comes in contact with the patient.

7. The disposable soap-dispensing bathing glove according to claim 6 wherein each soap ball selected from the plurality of soap balls is a solid phase chemical compound;

wherein the solid phase chemical compound is a surfactant that dissolves both in non-polar and polar solvents such as a liquid phase lipid and liquid phase water respectively.

8. The disposable soap-dispensing bathing glove according to claim 7 wherein each soap ball selected from the plurality of soap balls mounts on the glove structure.

9. The disposable soap-dispensing bathing glove according to claim 8 wherein each soap ball selected from the plurality of soap balls releases the solid phase chemical compound when the selected soap ball is rubbed against the surface that comes in contact with the patient;

wherein each soap ball selected from the plurality of soap balls releases the solid phase chemical compound when the selected soap ball is exposed to a solvent selected from the group consisting of: a) a liquid phase non-polar solvent; and, b) a liquid phase polar solvent.

10. The disposable soap-dispensing bathing glove according to claim 9 wherein each soap ball selected from the plurality of soap balls is identical.

11. The disposable soap-dispensing bathing glove according to claim 10 wherein each soap ball selected from the plurality of soap balls is formed as the major section of a spherical section;

wherein each soap ball selected from the plurality of soap balls permanently attaches to the exterior surface of the glove structure;

wherein each soap ball selected from the plurality of soap balls attaches to the glove structure such that the bifurcating plane of the spherical section structure of the selected soap ball sits flush on the palm side of the glove structure.

12. The disposable soap-dispensing bathing glove according to claim 11 wherein the plurality of soap balls are distributed across: a) the palm side of the trank of the glove structure; and, b) the palm side of each finger stall selected from the plurality of finger stalls of the glove structure.

13. The disposable soap-dispensing bathing glove according to claim 12 wherein the glove structure and the plurality of soap balls combine to form a disposable structure;

wherein the combination of the glove structure and the plurality of soap balls are disposed of after the chemical compound that forms the plurality of soap balls has been consumed.

* * * * *